US006996461B2

(12) United States Patent
Kane et al.

(10) Patent No.: US 6,996,461 B2
(45) Date of Patent: Feb. 7, 2006

(54) METHOD AND SYSTEM FOR ENSURING THAT A TRAIN DOES NOT PASS AN IMPROPERLY CONFIGURED DEVICE

(75) Inventors: Mark Edward Kane, Orange Park, FL (US); James Francis Shockley, Orange Park, FL (US); Harrison Thomas Hickenlooper, Palatka, FL (US)

(73) Assignee: Quantum Engineering, Inc., Orange Park, FL (US)

( * ) Notice: Subject to any disclaimer, the term of this patent is extended or adjusted under 35 U.S.C. 154(b) by 0 days.

(21) Appl. No.: 10/267,959

(22) Filed: Oct. 10, 2002

(65) Prior Publication Data

US 2004/0073342 A1 Apr. 15, 2004

(51) Int. Cl.
*G05D 13/00* (2006.01)

(52) U.S. Cl. ..... 701/19; 246/182 B; 701/20; 116/36

(58) Field of Classification Search ..... 701/19, 701/301; 246/292, 182 R, 124, 284, 473 R, 246/270 R, 167 R, 182 B; 348/148, 149; 340/591, 425.5, 438, 439; 105/1.4; 116/36, 116/37

See application file for complete search history.

(56) References Cited

U.S. PATENT DOCUMENTS

| | | | | |
|---|---|---|---|---|
| 4,181,943 | A | 1/1980 | Mercer, Sr. et al. | |
| 4,459,668 | A | 7/1984 | Inoue et al. | |
| 4,561,057 | A | 12/1985 | Haley, Jr. et al. | |
| 4,711,418 | A | 12/1987 | Aver, Jr. et al. | |
| 5,072,900 | A | 12/1991 | Malon | |
| 5,092,544 | A * | 3/1992 | Petit et al. | 246/126 |
| 5,129,605 | A | 7/1992 | Burns et al. | |
| 5,177,685 | A | 1/1993 | Davis et al. | |
| 5,332,180 | A | 7/1994 | Peterson et al. | |
| 5,340,062 | A | 8/1994 | Heggestad | |
| 5,364,047 | A | 11/1994 | Petit et al. | |
| 5,394,333 | A | 2/1995 | Kao | |
| 5,398,894 | A | 3/1995 | Pascoe | |
| 5,452,870 | A | 9/1995 | Heggestad | |
| 5,533,695 | A | 7/1996 | Heggestad et al. | |
| 5,620,155 | A | 4/1997 | Michalek | |
| 5,699,986 | A | 12/1997 | Welk | |
| 5,740,547 | A | 4/1998 | Kull et al. | |
| 5,751,569 | A | 5/1998 | Metel et al. | |

(Continued)

OTHER PUBLICATIONS

"Testimony of Jolene M. Molitoris, Federal Railroad Administrator, U.S. Department of Transportation before the House Committee on Transportation and Infrastructure Subcommittee on Railroads", Federal Railroad Administration, United States Department of Transportation, Apr. 1, 1998.

(Continued)

*Primary Examiner*—Thomas G. Black
*Assistant Examiner*—Christine M. Behncke
(74) *Attorney, Agent, or Firm*—DLA Piper Rudnick Gray Cary US LLP

(57) ABSTRACT

A train control system includes a positioning system and consults a database to determine when the train is approaching a configurable device such as a switch or grade crossing gate. The system continuously interrogates the device to determine its status as the train approaches the device, and forces an engineer/conductor to acknowledge any detected malfunction. The train is forced to come to a complete stop before proceeding past the device or may be slowed down to a speed that will allow the engineer/conductor to visually determine whether it is safe to proceed past the device if the engineer/conductor acknowledges a message warning of the malfunction and will stop the train if the engineer/conductor fails to acknowledge the warning message.

66 Claims, 4 Drawing Sheets

U.S. PATENT DOCUMENTS

| | | | | | |
|---|---|---|---|---|---|
| 5,803,411 | A | * | 9/1998 | Ackerman et al. | 246/169 R |
| 5,828,979 | A | * | 10/1998 | Polivka et al. | 701/117 |
| 5,867,122 | A | | 2/1999 | Zahm et al. | |
| 5,944,768 | A | | 8/1999 | Ito et al. | |
| 5,950,966 | A | * | 9/1999 | Hungate et al. | 246/62 |
| 5,978,718 | A | * | 11/1999 | Kull | 701/19 |
| 5,995,881 | A | | 11/1999 | Kull | |
| 6,049,745 | A | | 4/2000 | Douglas et al. | |
| 6,081,769 | A | | 6/2000 | Curtis | |
| 6,102,340 | A | | 8/2000 | Peek et al. | |
| 6,135,396 | A | | 10/2000 | Whitfield et al. | |
| 6,179,252 | B1 | | 1/2001 | Roop et al. | |
| 6,218,961 | B1 | | 4/2001 | Gross et al. | |
| 6,311,109 | B1 | | 10/2001 | Hawthorne et al. | |
| 6,322,025 | B1 | | 11/2001 | Colbert et al. | |
| 6,345,233 | B1 | * | 2/2002 | Erick | 701/301 |
| 6,371,416 | B1 | | 4/2002 | Hawthorne | |
| 6,373,403 | B1 | | 4/2002 | Korver et al. | |
| 6,374,184 | B1 | | 4/2002 | Zahm et al. | |
| 6,377,877 | B1 | | 4/2002 | Doner | |
| 6,397,147 | B1 | | 5/2002 | Whitehead | |
| 6,421,587 | B2 | | 7/2002 | Diana et al. | |
| 6,456,937 | B1 | | 9/2002 | Doner et al. | |
| 6,459,964 | B1 | | 10/2002 | Vu et al. | |
| 6,459,965 | B1 | * | 10/2002 | Polivka et al. | 701/19 |
| 6,487,478 | B1 | | 11/2002 | Azzaro et al. | |
| 6,609,049 | B1 | * | 8/2003 | Kane et al. | 701/19 |
| 2001/0056544 | A1 | | 12/2001 | Walker | |
| 2002/0070879 | A1 | | 6/2002 | Gazit et al. | |
| 2002/0096605 | A1 | * | 7/2002 | Berry et al. | 246/292 |

OTHER PUBLICATIONS

"System Architecture, ATCS Specification 100", May 1995.
"A New World for Communications & Signaling", Progressive Railroading, May 1986.
"Advanced Train Control Gain Momentum", Progressive Railroading, Mar. 1986.
"Railroads Take High Tech in Stride", Progressive Railroading, May 1985.
Lyle, Denise, "Positive Train Control on CSXT", Railway Fuel and Operating Officers Association, Annual Proceedings, 2000.
Lindsey, Ron A., "C B T M, Communications Based Train Management", Railway Fuel and Operating Officers Association, Annual Proceedings, 1999.
Moody, Howard G, "Advanced Train Control Systems A System to Manage Railroad Operations", Railway Fuel and Operating Officers Association, Annual Proceedings, 1993.
Ruegg, G.A., "Advanced Train Control Systems ATCS", Railway Fuel and Operating Officers Association, Annual Proceedings, 1986.
Malone, Frank, "The Gaps Start to Close"Progressive Railroading, May 1987.
"On the Threshold of ATCS", Progressive Railroading, Dec. 1987.
"CP Advances in Train Control", Progressive Railroading, Sep. 1987.
"Communications/Signaling: Vital for dramatic railroad advances", Progressive Railroading, May 1988.
"ATCS's System, Engineer", Progressive Railroading, Jul. 1988.
"The Electronic Railroad Emerges", Progressive Railroading, May 1989.
"$C^3$ Comes to the Railroads", Progressive Railroading, Sep. 1989.
"ATCS on Verge of Implementation", Progressive Railroading, Dec. 1989.
"ATCS Evolving'on Railroads", Progressive Railroading, Dec. 1992.
"High Tech Advances Keep Railroads Rolling", Progressive Railroading, May 1994.
"FRA Promotes Technology to Avoid Train-To-Train Collisions", Progressive Railroading, Aug. 1994.
"ATCS Moving slowly but Steadily from Lab for Field", Progressive Railroading, Dec. 1994.
Judge, T., "Electronic Advances Keeping Railroads Rolling", Progressive Railroading, Jun. 1995.
"Electronic Advances Improve How Railroads Manage", Progressive Railroading, Dec. 1995.
Judge, T., "BNSF/UP PTS Pilot Advances in Northwest", Progressive Railroading, May 1996.
Foran, P., "Train Control Quandary, Is CBTC viable? Railroads, Suppliers Hope Pilot Projects Provide Clues", Progressive Railroading, Jun. 1997.
"PTS Would've Prevented Silver Spring Crash: NTSB", Progressive Railroading, Jul. 1997.
Foran, P., "A 'Positive' Answer to the Interoperability Call", Progressive Railroading, Sep. 1997.
Foran, P., "How Safe is Safe Enough?", Progressive Railroading, Oct. 1997.
Foran, P., "A Controlling Interest In Interoperability", Progressive Railroading, Apr. 1998.
Derocher, Robert J., "Transit Projects Setting Pace for Train Control", Progressive Railroading, Jun. 1998.
Kube, K., "Variations on a Theme", Progressive Railroading, Dec. 2001.
Kube, K., "Innovation in Inches", Progressive Railroading, Feb. 2002.
Vantuono, W., "New York Leads a Revolution", Railway Age, Sep. 1996.
Vantuono, W., "Do your know where your train is?", Railway Age, Feb. 1996.
Gallamore, R., "The Curtain Rises on the Next Generation", Railway Age, Jul. 1998.
Burke, J., "How R&D is Shaping the 21st Century Railroad", Railway Age, Aug. 1998.
Vantuono, W., "CBTC: A Maturing Technology", Third International Conference On Communications Based Train Control, Railway Age, Jun. 1999.
Sullivan, T., "PTC—Is FRA Pushing Too Hard?", Railway Age, Aug. 1999.
Sullivan, T., "PTC: A Maturing Technology", Railway Age, Apr. 2000.
Moore, W., "How CBTC Can Increase Capacity", Railway Age, Apr. 2001.
Vantuono, W., "CBTC: The Jury is Still Out", Railway Age, Jun. 2001.
Vantuono, W., "New-tech Train Control Takes Off", Railway Age, May 2002.
Union Switch & Signal Intermittent Cab Signal, Bulletin 53, 1998.
GE Harris Product Sheet: "Advanced Systems for Optimizing Rail Performance" and "Advanced Products for Optimizing train Performance", undated.
GE Harris Product Sheet: "Advanced, Satellite-Based Warning System Enhances Operating Safety", undated.
Furman, E., et al., "Keeping Track of RF", GPS World. Feb. 2001.
Department of Transportation Federal Railroad Administration, Federal Register, vol. 66, No. 155, pp. 42352-42396, Aug. 10, 2001.

* cited by examiner

A

Speed Reduced Sufficiently
N
B
Y
336
MonitorSpeed
338
Past Device?
Y
N
339
340
N
Operator Verified Proper Configuration
Y
Resume Normal Speed
C
342
B
Stop Train
344
Notify Dispatcher
END

METHOD AND SYSTEM FOR ENSURING THAT A TRAIN DOES NOT PASS AN IMPROPERLY CONFIGURED DEVICE

BACKGROUND OF THE INVENTION

1. Field of the Invention

The invention relates to railroads generally, and more particularly to a method and system for ensuring that a train does not pass a device such as a grade crossing gate or a track switch when that device is not properly configured.

2. Discussion of the Background

Train safety has always been a concern in the railroad industry. If anything, this concern has increased in recent years. This concern has led to proposals for and development of automated, safety-enhancing systems such as Automatic Train Control (ATC), Positive Train Control (PTC), and others. While such systems vary in their implementation, one goal they all share is to avoid accidents.

One source of accidents is an improperly set switch. Historically, an engineer or conductor would visually verify that a switch has been set to the correct position. However, engineers and conductors, being human, sometimes make mistakes, including traveling too fast such that there is not sufficient time to stop the train when the signal is first visible, not activating the brakes a sufficient distance from the switch, failing to notice that the switch has been improperly set, and even forgetting to look at the switch. The results of such mistakes can be disastrous.

Another source of accidents is a malfunctioning grade crossing gate. Grade crossing gates may be triggered by radar, by a track circuit, or by a mechanical switch set at a position far enough away from the crossing gate such that the gate will have sufficient time to go down when triggered by a train traveling at the maximum allowable speed. Some gates are equipped with monitoring equipment that can determine if the gate is malfunctioning and, in some cases, sends a message via telephone or radio informing the dispatcher of a malfunction. The dispatcher is then required to broadcast this information to all other trains that pass the grade crossing.

What is needed is a method and apparatus that ensures that a train will not pass a switch, grade crossing gate, or other device that is not properly configured.

SUMMARY OF THE INVENTION

The present invention meets the aforementioned need to a great extent by providing a computerized train control system in which a control module determines a position of a train using a positioning system such as a global positioning system (GPS), consults a database to determine when the train is approaching a configurable device such as a switch or grade crossing gate, continuously interrogates the device to determine its status as the train approaches the device, and forces an engineer/conductor to acknowledge any detected malfunction. A malfunction can be reported by the device itself, or can be declared by the system if the device fails to respond to initial or subsequent interrogations. In some embodiments of the invention, the train is forced to come to a complete stop before proceeding past the device. In other embodiments, the train will slow to a speed that will allow the engineer/conductor to visually determine whether it is safe to proceed past the device if the engineer/conductor acknowledges a message warning of the malfunction and will stop the train if the engineer/conductor fails to acknowledge the warning message.

BRIEF DESCRIPTION OF THE DRAWINGS

A more complete appreciation of the invention and many of the attendant features and advantages thereof will be readily obtained as the same become better understood by reference to the following detailed description when considered in connection with the accompanying drawings, wherein.

DETAILED DESCRIPTION OF PREFERRED EMBODIMENTS

The present invention will be discussed with reference to preferred embodiments of train control systems. Specific details, such as specific algorithms and hardware, are set forth in order to provide a thorough understanding of the present invention. The preferred embodiments discussed herein should not be understood to limit the invention. Furthermore, for ease of understanding, certain method steps are delineated as separate steps; however, these steps should not be construed as necessarily distinct nor order dependent in their performance.

Figure 1:
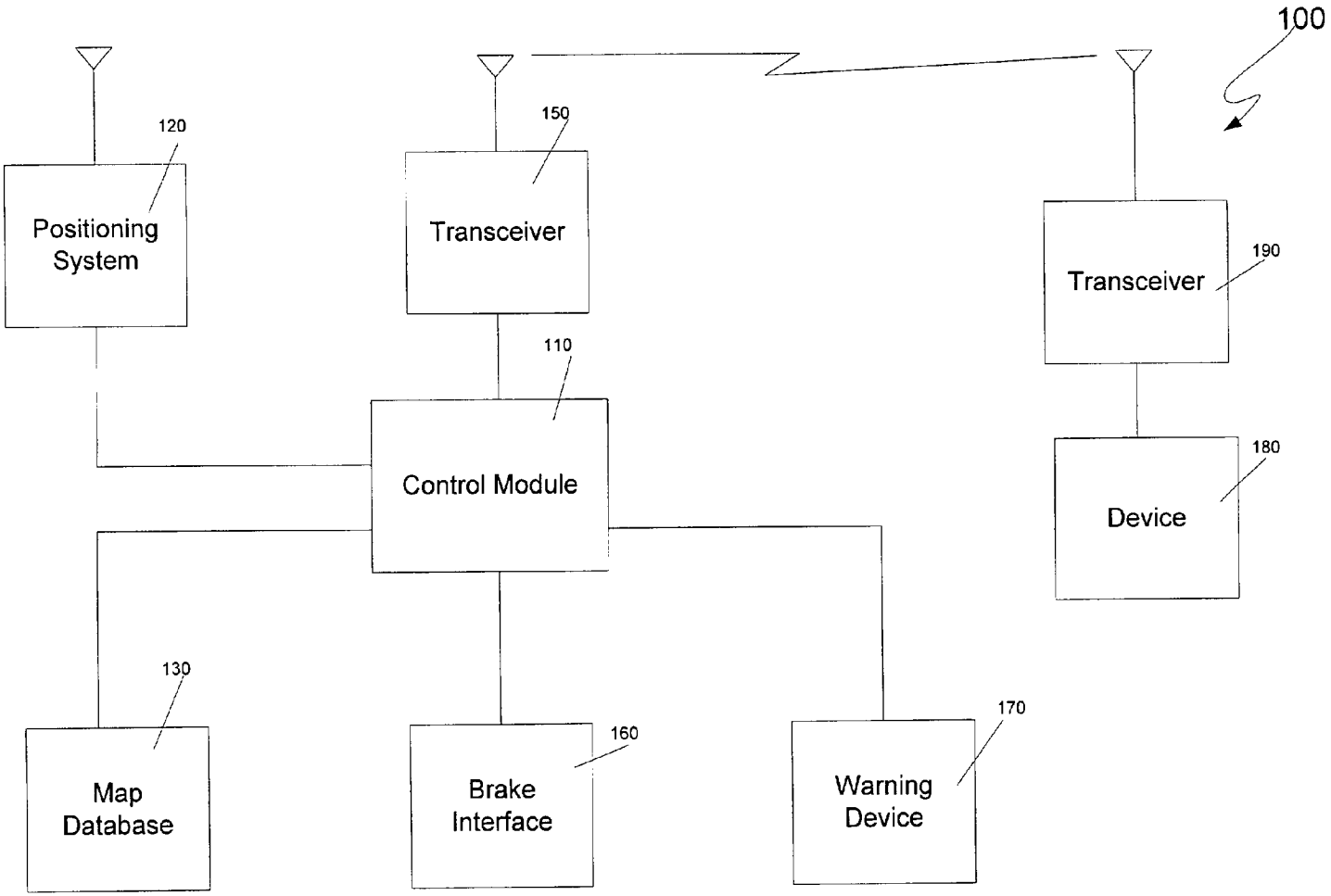
FIG. 1 is a logical block diagram of a train control system according to one embodiment of the invention.

Referring now to the drawings, wherein like reference numerals designate identical or corresponding parts throughout the several views, FIG. 1 is a logical block diagram of a train control system 100 according to an embodiment of the present invention. The system 100 includes a control module 110, which typically, but not necessarily, includes a microprocessor. The control module 110 is responsible for controlling the other components of the system.

A positioning system 120 is connected to the control module 110. The positioning system supplies the position (and, in some cases, the speed) of the train to the control module 110. The positioning can be of any type, including a global positioning system (GPS), a differential GPS, an inertial navigation system (INS), or a Loran system. Such positioning systems are well known in the art and will not be discussed in further detail herein. (As used herein, the term "positioning system" refers to the portion of a positioning system that is commonly located on a mobile vehicle, which may or may not comprise the entire system. Thus, for example, in connection with a global positioning system, the term "positioning system" as used herein refers to a GPS receiver and does not include the satellites that transmit information to the GPS receiver.)

A map database 130 is also connected to the control module 110. The map database 130 preferably comprises a non-volatile memory such as a hard disk, flash memory, CD-ROM or other storage device, on which map data is stored. Other types of memory, including volatile memory, may also be used. The map data preferably includes positions of all configurable devices such as switches and grade crossing gates. The map data preferably also includes information concerning the direction and grade of the track in the railway. By using train position information obtained from the positioning system 120 as an index into the map database 130, the control module 110 can determine its position relative to configurable devices.

When the control module 110 determines that a configurable device 180 (which includes a transceiver 190) is present, it interrogates the device 180 through transceiver 150. The transceiver 150 can be configured for any type of communication, including communicating through rails and wireless. In addition to communicating with configurable devices 180, the transceiver 150 may communicate with a dispatcher (not shown in FIG. 1).

Also connected to the control module 110 is a brake interface 160. The brake interface 160 monitors the train brakes and allows the control module 110 to activate and control the brakes to stop or slow the train when necessary.

A warning device 170 is also connected to the control module 110. The warning device 170 is used to warn the conductor/engineer that a malfunction has been detected. The warning device 170 may also be used to allow the engineer/conductor to acknowledge the warning. In some embodiments, the warning device 170 is in the form of button on an operator display such as the display illustrated in co-pending U.S. application Ser. No. 10/186,426, entitled "Train Control System and Method of Controlling a Train or Trains" filed Jul. 2, 2002, the contents of which are hereby incorporated by reference herein. In other embodiments, the warning device 170 may be a stand alone button that illuminates when a malfunction is detected. In yet other embodiments (e.g., those in which no acknowledgment of a warning is required), the warning device 170 may comprise or consist of a horn or other device capable of providing an audible warning.

Figure 2:
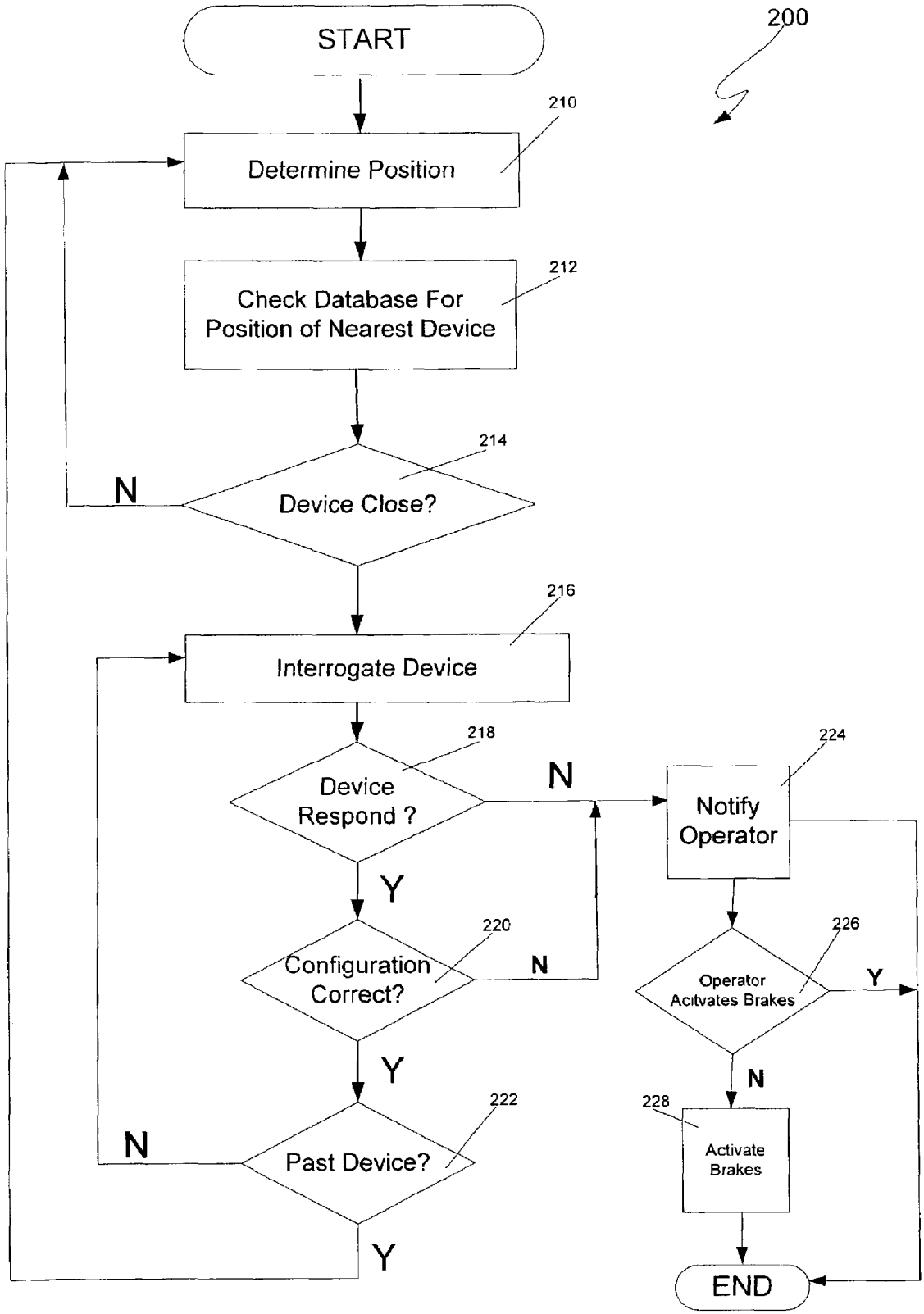
FIG. 2 is a flow chart of a device interrogation method according to another embodiment of the invention.

FIG. 2 is a flowchart 200 illustrating operation of the processor 110 in connection with configurable devices 180. The control module 110 determines the train's current position from information provided by the positioning system 120 at step 210. The control module then obtains the locations of nearby configurable devices 180 from the map database 130 at step 212. If no configurable device 180 is withing a threshold distance, steps 210 et seq. are repeated. If a configurable device 180 is within a threshold distance at step 214, the device is interrogated at step 216.

In some embodiments, this threshold distance is predetermined distance based in part upon a worst case assumption (i.e., an assumption that a train having the greatest possible weight is traveling at a maximum allowable or possible speed in a downhill direction on a portion of track with the steepest grade in the system). In other embodiments, the threshold is based on the actual speed and weight of the train and the grade of the track between the train and the device. In still other embodiments, the calculation may take into account the distribution of weight in the train this will effect the required stopping distance as discussed in the aforementioned co-pending U.S. patent application.

In some embodiments, the interrogation includes an identification number associated with the device 180. Since only the device corresponding to the identification number will respond to the interrogation, this identification number is obtained from the map database 130. This avoids contention between multiple devices attempting to respond to the interrogation on the same frequency.

If the configurable device 180 fails to respond at step 218, or reports an incorrect configuration at step 220, the control module notifies the conductor/engineer of the malfunction at step 224. If, in response to the notification, the operator fails to activate the brakes at step 226, the control module 110 automatically activates the brakes to bring the train to a halt at step 228. At this point, the conductor/engineer must restart the train, which preferably requires the conductor/engineer to acknowledge the warning provided at step 224.

If the device 180 responds to the interrogation at step 218 and reports a correct configuration at step 220, then, at step 222, the control module 110 returns to step 216 if the device 180 has not been passed, or returns to step 210 to repeat the process for the next configurable device 180. Returning to step 216 to interrogate the device multiple times as the train approaches the device is important for safety purposes. This will detect malfunctions or changes in configuration after the initial interrogation (e.g., someone throwing the switch into the wrong position after the initial interrogation but before the train reaches the switch) from causing and accident. Whether or not the interrogation of step 318 includes the device's identification number, it is preferable for the device's response to include its identification number as this allows for greater assurance that a response from some other source has not been mistaken as a response from the device.

Figure 3A:
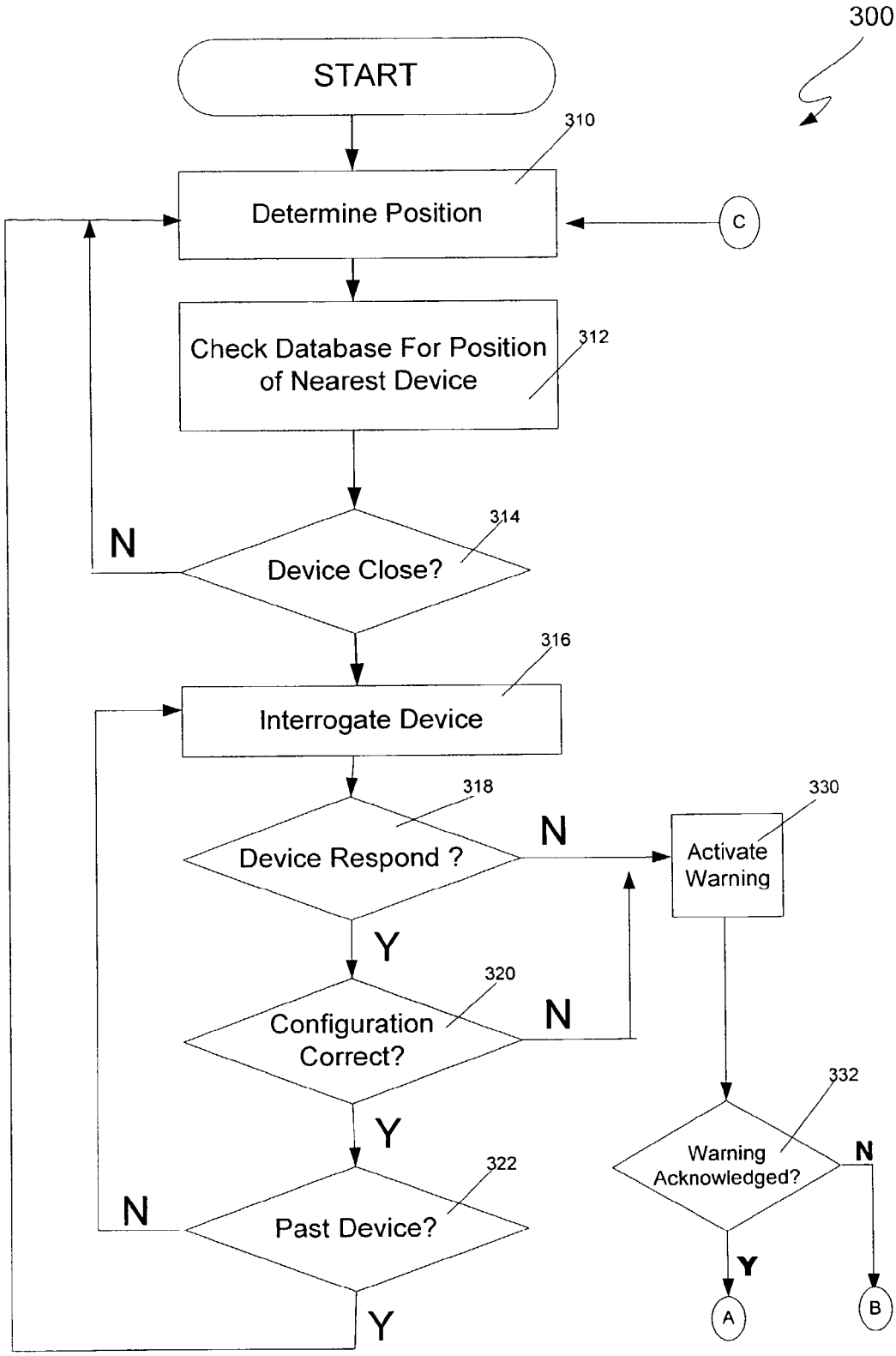
FIGS. 3*a* and 3*b* are a flow chart of a device interrogation method according to a third embodiment of the invention.
Figure 3B:
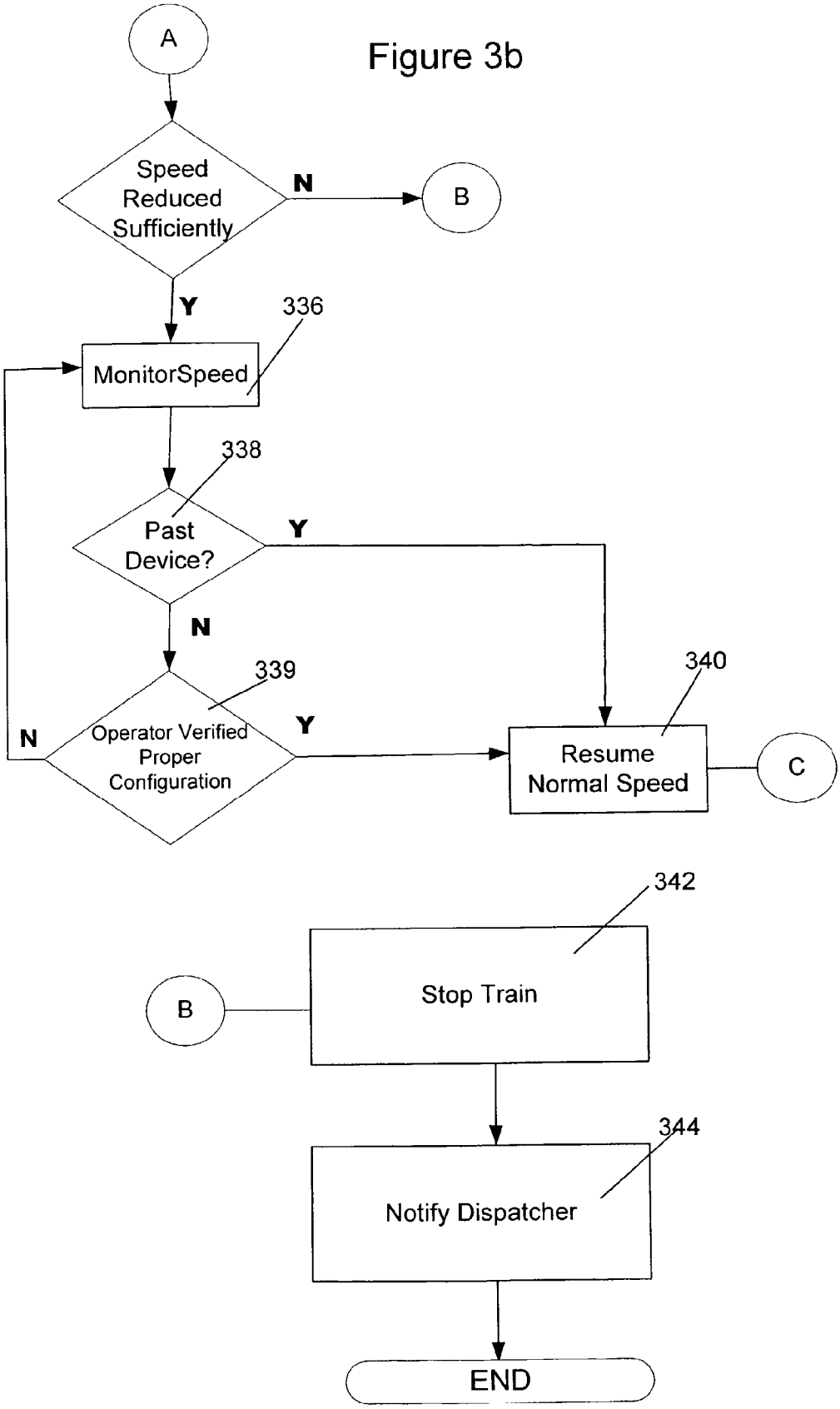

FIGS. 3*a* and 3*b* together form a flowchart 300 illustrating operation of the control unit 110 in connection with configurable devices 180 according to a second embodiment of the invention. Steps 310–322 of the flowchart 300 are similar to steps 210–222 of the flowchart 200 of FIG. 2; therefore, the detailed discussion of these steps will not be repeated. If a configurable device 180 does not respond at step 318 or reports an incorrect configuration at step 320 after being interrogated at step 316, the control module 10 then activates the warning device 170 to inform the conductor/engineer of the problem at step 330. A time period within which the operator must acknowledge the warning and slow the train to a reduced speed is associated with the warning. This time period may be a predetermined number based on a worst-case stopping distance, or may be calculated dynamically based on factors such as the current speed of the train, the braking characteristics of the brakes on the train, the weight of the train, the distribution of weight on the train, and/or the grade of the track as determined from the map database 130 using the train position from the positioning system 120, or other factors as discussed in the above-referenced co-pending U.S. patent application.

If the operator acknowledges the warning at step 332 and sufficiently slowed the train at step 334 within the allowable time period, the control module 110 monitors the speed of the train to ensure that the reduced speed is maintained at step 336 until either the train has passed the device 180 at step 338 or the conductor/engineer verifies that he has visually determined that the device is configured properly at step 340. In the case of a configurable device such as a grade crossing gate, this allows the train to continue moving past the gate at a slow speed. In the case of an incorrectly thrown switch, it is expected that the conductor/engineer will stop the train if the switch cannot be set to the correct position before the train reaches it; however, there may be some circumstances in which the conductor/engineer desires to allow the train to continue past an incorrectly thrown switch. Because the conductor/engineer was forced to acknowledge the warning about the improperly configured switch, it is unlikely that allowing the train to proceed past the improperly configured switch is not intentional. In other embodiments, a train may not be allowed to pass the switch until it has come to a complete stop, but may be allowed to pass an improperly configured grade crossing gate at a reduced speed without first coming to a complete stop.

If the conductor/engineer fails to acknowledge the warning at step 334 within the allowed time period, the control module 110 commands the brake interface to stop the train at step 342. The control module 110 then notifies the dispatcher of the stopped train at step 344.

At steps 220 and 320 above, the control module 110 determines whether the device 180 is properly configured. This determination is necessarily device dependent. For example, in the case of a switch, the determination as to whether the device is configured correctly is preferably made with respect to warrants/authorities and/or route information issued to the train. That is, the control module 110 preferably stores information as to what route the train is to take and what warrants (also sometimes referred to as authorities) have been issued for that train. In the case of a grade crossing gate, determining that the device is configured properly comprises more than determining that the gate is in the down position. Many such devices are designed such that a failure results in the gate being placed in the down position. However, in the event of such a failure, it can be expected that some cars and/or pedestrians may attempt to cross the tracks even though the gate is down. Thus, if the crossing gate reports a malfunction, it is preferably treated as if it is not properly configured despite the fact that the gates may be reported as being in the down position.

It should be understood that any and all of the aforementioned events (e.g., the acknowledgment or lack thereof of a warning from an engineer/conductor, the stopping of the train upon a detection of an improperly configured device) may be recorded by the event recorder 140. It should also be understood that, in some embodiments, some configurable devices 180 may be configured by sending commands from the train. In such embodiments, the control module 110 will send the appropriate command via the transceiver 150 on the train to the device 180 via its transceiver 190.

One advantage of those embodiments of the invention in which a configurable device is interrogated as the train approaches is that such devices are not required to transmit information when trains are not in the area. This saves power as compared to those systems in which wayside devices continuously or periodically transmit information regardless of whether a train is close enough to receive such information.

In the embodiments discussed above, the control module 110 is located on the train. It should also be noted that some or all of the functions performed by the control module 110 could be performed by a remotely located processing unit such as processing unit located at a central dispatcher. In such embodiments, information from devices on the train (e.g., the brake interface 160) is communicated to the remotely located processing unit via the transceiver 150.

Obviously, numerous modifications and variations of the present invention are possible in light of the above teachings. It is therefore to be understood that within the scope of the appended claims, the invention may be practiced otherwise than as specifically described herein.

What is claimed is:

1. A system for controlling a train, the system comprising:

a control unit; and a transceiver, the transceiver being located on the train and being in communication with the control unit;

wherein the control unit is configured to perform the steps of transmitting an interrogation message to a configurable device near the train;

listening for a response from the configurable device, the response including a configuration of the configurable device and an identifier of the device;

allowing the train to continue if a response with a correct configuration is received within a period of time; and stopping the train otherwise;

wherein the control unit is further configured to perform the step of confirming that the identifier received in the response corresponds to the device to which the interrogation message was directed.

2. The system of claim 1, wherein the device is a grade crossing gate.

3. The system of claim 1, wherein the device is a switch.

4. The system of claim 1, wherein the interrogation message includes an identifier of a device for which the interrogation message is intended.

5. The system of claim 1, further comprising:

a positioning system, the positioning system being in communications with the control unit and being configured to provide position information to the control unit; and a database, the database including a plurality of locations for a plurality of configurable devices;

wherein the control unit is further configured to perform the steps of identifying a configurable device in the database which is a next device which the train will pass based on information from the positioning system; and obtaining an identifier from the database associated with the device identified in the identifying step.

6. The system of claim 5, wherein the control unit is configured to transmit the interrogation message when a distance between the train's location and the configurable device identified in the identifying step is below a threshold.

7. The system of claim 6, wherein the threshold is a predetermined number based at least in part on an expected worst case distance required to stop the train.

8. The system of claim 6, wherein the threshold is determined dynamically based at least in part upon the current speed of the train.

9. The system of claim 8, wherein the threshold is further based on a weight of the train.

10. The system of claim 8, wherein the database further includes a grade of a track between the train and the device and the threshold is further based on the grade of the track between the train and the device.

11. The system of claim 10, wherein the threshold is further based on distribution of weight in the train.

12. The system of claim 1, further comprising a warning device connected to the control unit, wherein the control unit is further configured to activate the warning device when a response with a correct configuration is not received.

13. The system of claim 12, wherein the control unit is further configured to perform the step of preventing the train from moving until an acknowledgment of the activated warning device has been received.

14. A method for controlling a train comprising the steps of:

transmitting an interrogation message from the train to a configurable device near the train;

listening for a response from the configurable device, the response including a configuration of the configurable device and an identifier of the configurable device;

confirming that the identifier received in the response corresponds to the configurable device to which the interrogation message was directed;

allowing the train to continue if a response with a correct configuration is received; and stopping the train otherwise.

15. The method of claim 14, wherein the device is a grade crossing gate.

16. The method of claim 14, wherein the device is a switch.

17. The method of claim 16, further comprising the steps of storing route information from a dispatcher in a memory and determining whether the switch is properly configured by comparing an actual direction of the switch to a desired direction of the switch based on the route information.

18. The method of claim 14, wherein the interrogation message includes an identifier of a device for which the interrogation message is intended.

19. The method of claim 14, further comprising the steps of:

identifying a configurable device in a database which is a next device which the train will pass based on information from a positioning system located on the train; and obtaining an identifier associated with the device identified in the identifying step from the database.

20. The method of claim 19, wherein the interrogation message is transmitted when a distance between the train's location and the configurable device identified in the identifying step is below a threshold.

21. The method of claim 20, wherein the threshold is a predetermined number based at least in part on an expected worst case distance required to stop the train.

22. The method of claim 20, wherein the threshold is determined dynamically based at least in part upon the current speed of the train.

23. The method of claim 22, wherein the threshold is further based on a weight of the train.

24. The method of claim 22, wherein the database further includes a grade of a track between the train and the device and the threshold is further based on the grade of the track between the train and the device.

25. The method of claim 24, wherein the threshold is further based on distribution of weight in the train.

26. The method of claim 14, further comprising the step of activating a warning device when a response with a correct configuration is not received.

27. The method of claim 26, further comprising the step of preventing the train from moving until an acknowledgment of the activated warning device has been received.

28. A system for controlling a train, the system comprising:

a control unit; and a transceiver, the transceiver being located on the train and being in communication with the control unit;

wherein the control unit is configured to perform the steps of transmitting an interrogation message to a configurable device near the train;

listening for a response from the configurable device, the response including a configuration of the configurable device and an identifier associated with the configurable device;

allowing the train to continue if a response with a correct configuration is received;

if no response is received or if a response with an incorrect configuration is received, activating a warning device to provide a warning to a train operator;

stopping the train if an acknowledgment of the warning is not received or if a speed of the train is not reduced within a period of time; and if an acknowledgment of the warning is received within the period of time, maintaining the speed until the device has been passed or a verification that passing the device is acceptable has been received;

wherein the control unit is further configured to perform the step of confirming that identifier received in the response corresponds to the device to which the interrogation message was directed.

29. The system of claim 28, wherein the device is a grade crossing gate.

30. The system of claim 28, wherein the device is a switch.

31. The system of claim 28, wherein the interrogation message includes an identifier of a device for which the interrogation message is intended.

32. The system of claim 28, further comprising:

a positioning system, the positioning system being in communications with the control unit and being configured to provide position information to the control unit; and a database, the database including a plurality of locations for a plurality of configurable devices;

wherein the control unit is further configured to perform the steps of identifying a configurable device in the database which is a next device which the train will pass based on information from the positioning system; and obtaining an identifier from the database associated with the device identified in the identifying step.

33. The system of claim 32, wherein the control unit is configured to transmit the interrogation message when a distance between the train's location and the configurable device identified in the identifying step is below a threshold.

34. The system of claim 32, wherein the threshold is a predetermined number based at least in part on an expected worst case distance required to stop the train.

35. The system of claim 32, wherein the threshold is determined dynamically based at least in part upon the current speed of the train.

36. The system of claim 35, wherein the threshold is further based on a weight of the train.

37. The system of claim 35, wherein the database further includes a grade of a track between the train and the device and the threshold is further based on the grade of the track between the train and the device.

38. The system of claim 37, wherein the threshold is further based on distribution of weight in the train.

39. The system of claim 28, further comprising a warning device connected to the control unit, wherein the control unit is further configured to activate the warning device when a response with a correct configuration is not received.

40. The system of claim 39, wherein the control unit is further configured to perform the step of preventing the train from moving until an acknowledgment of the activated warning device has been received.

41. The system of claim 28, wherein the period of time is based on a worst- case assumption that the train is traveling at a maximum speed and weighs a maximum amount.

42. The system of claim 28, further comprising a positioning system in communication with the control unit and located on the train, wherein the period of time is based on an actual speed of the train based on information reported by the positioning system and a weight of the train.

43. The system of claim 42, further comprising a track database in communication with the control unit, wherein the period of time is further based on a grade of a section of track between the train and the device.

44. A method for controlling a train comprising the steps of:

transmitting an interrogation message from the train to a configurable device near the train;

listening for a response from the configurable device, the response including a configuration of the configurable device and an identifier of the configurable device;

allowing the train to continue if a response with a correct configuration is received and the identifier received in the response corresponds to the device to which the interrogation message was directed.

if a response with a correct configuration and an identifier corresponding to the configurable device to which the interrogation message was directed is not received, or if no response is received;

activating a warning device to provide a warning;

stopping the train if an acknowledgment of the warning is not received or if a speed of the train is not reduced within a period of time; and if an acknowledgment of the warning is received within the period of time, maintaining the speed until the device has been passed or a verification that passing the configurable device is acceptable has been received.

45. The method of claim 44, wherein the device is a grade crossing gate.

46. The method of claim 44, wherein the device is a switch.

47. The method of claim 44, wherein the interrogation message includes an identifier of a device for which the interrogation message is intended.

48. The method of claim 44, further comprising the steps of:

identifying a configurable device in the database which is a next device which the train will pass based on information from a positioning system; and obtaining an identifier associated with the device identified in the identifying step from a database.

49. The method of claim 48, wherein the interrogation message is transmitted when a distance between the train's location and the configurable device identified in the identifying step is below a threshold.

50. The method of claim 48, wherein the threshold is a predetermined number based at least in part on an expected worst case distance required to stop the train.

51. The method of claim 48, further comprising the step of calculating the threshold based at least in part upon the current speed of the train.

52. The method of claim 51, wherein the threshold is further based on a weight of the train.

53. The method of claim 51, wherein the database further includes a grade of a track between the train and the device and the threshold is further based on the grade of the track between the train and the device.

54. The method of claim 53, wherein the threshold is further based on distribution of weight in the train.

55. The method of claim 44, further comprising the step of activating a warning device when a response with a correct configuration is not received.

56. The method of claim 55, further comprising the step of preventing the train from moving until an acknowledgment of the activated warning device has been received.

57. The method of claim 44, wherein the period of time is based on a worst- case assumption that the train is traveling at a maximum speed and weighs a maximum amount.

58. The method of claim 44, wherein the period of time is based on an actual speed of the train based on information reported by the positioning system and a weight of the train.

59. The method of claim 58, wherein the period of time is further based on a grade of a section of track between the train and the device.

60. The method of claim 59, wherein the configurable device is a switch and further comprising the steps of storing route information from a dispatcher in a memory and determining whether a configuration received from the switch is correct by comparing a direction of the switch to a desired direction of the switch based on the route information.

61. A method for controlling a train comprising the steps of:

obtaining a position of a train from a positioning system;

determining a location and an identifier of a next configurable device that will be passed by the train from a database;

sending an interrogation message including the identifier of the next configurable device;

waiting a period of time based in part on a speed and a weight of the train and a grade of a section of track between the train and the device;

listening for a response during the period of time;

if the response is received, comparing an identifier included in the response to the identifier of the next configurable device;

stopping the train if a response from the device indicates that the device is not properly configured or if a response is not received within the period of time.

62. The method of claim 61, further comprising the step of transmitting a command to the next configurable device, the command instructing the next configurable device to assume a proper configuration.

63. The method of claim 61, wherein the configurable device is a switch and further comprising the steps of storing route information from a dispatcher in a memory and determining whether the switch is properly configured by comparing a direction of the switch to a desired direction of the switch based on the route information.

64. A computerized method for controlling a train comprising the steps of:

obtaining a position of a train from a positioning system;

determining a location and identifier of a next configurable device that will be passed by the train from a database;

sending an interrogation message including the identifier of the next configurable device;

waiting a first period of time based in part on a speed and a weight of the train and a grade of a section of track between the train and the device;

listening for a response during the first period of time;

if the response is received, comparing an identifier included in the response to the identifier of the next configurable device;

providing a warning to an operator if a response from the device indicates that the device is not properly configured or if a response is not received within the first period of time;

stopping the train if the operator does not acknowledge the warning and slow the train to a reduced speed within a second period of time; and if the warning is acknowledged and the reduced speed is achieved within the second period of time, maintaining the reduced speed until the operator verifies that the device is configured properly or until the train has passed the device.

65. The method of claim 64, further comprising the step of transmitting a command to the next configurable device, the command instructing the next configurable device to assume a proper configuration.

66. The method of claim 64, wherein the configurable device is a switch and further comprising the steps of storing route information from a dispatcher in a memory and determining whether the switch is properly configured by comparing a direction of the switch to a desired direction of the switch based on the route information.

* * * * *